US006056682A

United States Patent [19]

Belanger et al.

[11] Patent Number: 6,056,682

[45] **Date of Patent: *May 2, 2000**

[54] METHOD AND APPARATUS FOR SEVERING A RUNNING MATERIAL WEB IN A FOLDING APPARATUS OF A WEB-FED ROTARY PRINTING PRESS

[75] Inventors: James Richard Belanger, Portsmouth; Kevin Lauren Cote, Durham; Richard Daniel Curley, Dover, all of N.H.

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/996,476

[22] Filed: Dec. 22, 1997

[51] Int. Cl.[7] ..... B24F 13/56

[52] U.S. Cl. ..... 493/340; 493/369; 493/370; 83/298; 83/310; 83/422; 83/734

[58] Field of Search ..... 493/369, 370, 493/361, 362, 53, 390, 340; 83/298, 308, 310, 422, 734, 325, 326, 341, 353, 174.1; 270/21.1

[56] References Cited

U.S. PATENT DOCUMENTS

| | | | |
|---|---|---|---|
| 1,427,971 | 9/1922 | Porter | 83/298 |
| 1,924,162 | 8/1933 | Mason | 83/298 |
| 2,547,157 | 4/1951 | Gibbons | 83/308 |
| 3,076,369 | 2/1963 | Overman | 83/298 |
| 3,149,517 | 9/1964 | Frydryk | 83/341 |
| 3,886,832 | 6/1975 | Harris | 83/308 |
| 4,009,628 | 3/1977 | Kato | 83/298 |
| 4,048,885 | 9/1977 | Miyakita | 83/298 |
| 4,160,894 | 7/1979 | Stemmler et al. | 493/340 |
| 4,444,077 | 4/1984 | Wise | 83/310 |
| 4,593,589 | 6/1986 | Gherardi | 83/310 |
| 4,643,061 | 2/1987 | Gerber | 83/174.1 |
| 4,799,660 | 1/1989 | Pfizenmaier | 270/21.1 |
| 4,983,155 | 1/1991 | Stobb | 493/369 |
| 5,334,129 | 8/1994 | Haller | 493/390 |

*Primary Examiner*—Peter Vo
*Assistant Examiner*—James Calve
*Attorney, Agent, or Firm*—Burns, Doane, Swecker & Mathis

[57] ABSTRACT

The present invention generally relates to severing a running material web in a folding apparatus of a web-fed rotary printing press. In one exemplary embodiment, a severing element is moved in the traveling direction of the web with a speed which is substantially equal to the speed of the running web and is simultaneously moved across the width of the web in a substantially lateral direction. The severing element can be a sled with a blade, a laser source, a high-pressure fluid jet or a heated wire. The severing element is received and guided by a guiding rail coupled to a pair of endless parallel transport chains.

20 Claims, 7 Drawing Sheets

10
$V_W$
12
14a
$V_1$
11
12
2
16b
$V_L$
$V_2$
18
14
16a
20
12
$V_L$
14b
20
$V_2$
18
12
$V_L$
20
$V_2$
18
20
2a
$V_3$
14c 8
22
30
30
34
24
36
32
28
40
38
2a
32
46
42
46
42
56
54
16b
26a
$V_w$
2
10
26b
16a 24
61
30
16a
30
58
10
60
44
44
46
16b 12
84
74
76
44
70
Fluid
72
80
82
78
46

METHOD AND APPARATUS FOR SEVERING A RUNNING MATERIAL WEB IN A FOLDING APPARATUS OF A WEB-FED ROTARY PRINTING PRESS

BACKGROUND OF THE INVENTION

1. Field of the Invention

The present invention relates to a method and an apparatus for severing a printed material web in a folding apparatus of a web-fed rotary printing press.

2. State of the Art

In conventional folding apparatuses as described, for example, in U.S. Pat. No. 5,334,129, rotating cutting cylinder systems having one or more blades mounted to the periphery of the cutting cylinder and extending across the width of the running paper web are used for cross-cutting the web. The web is cut into signatures as the cutting cylinder is rotated about an axis and the cutters are brought into contact with the travelling web. Once the web is cut into signatures, the signatures are fed to a cross folding unit for further processing.

However, every time the web is severed in typical cross-cutting cylinder systems, large impulses are imparted through the drive system of the printing press causing periodic web tension variations. These variations in tension are transmitted back through the web with each cut and thus adversely affect the quality of the printed images. Furthermore, when the knife or blade of known cross cutting cylinder systems swipes past the paper, this can cause the paper to follow the knife resulting in print-to-cut register errors and therefore reducing the ability for these systems to perform finish quality cuts.

Also, when processing single-layer or multi-layer webs, known prior art cutting systems show another deficiency in that the signatures are not completely restrained during and after the cutting operation. As a result, the leading end of the multi-layered web, which is created with each cut, is likely to open up and cause a jam in or damage to the folding section.

Furthermore, due to the high working load, the blades of the known prior art cross-cutting cylinders become dull after a comparatively short time and have to be replaced or resharpened frequently, in order to maintain a sufficient quality of the cut edges. This, in turn, reduces efficiency because the printer must be stopped to replace or resharpen the blades.

SUMMARY OF THE INVENTION

Given the state of the art as described above and its attendant disadvantages, it is accordingly an object of the present invention to provide a method and apparatus for cross-cutting a running material web which allows for a precise and smooth severing of the web, which reduces the danger of print-to-cut register errors to a minimum, and which further eliminates the occurrence of high frequency web tension variations. It is a further object of the present invention to provide a method and apparatus for cross-cutting a running paper web, in which no impulse forces are imparted on the drive system of the printing press.

According to an exemplary embodiment of the invention, a method for severing a running material web in a folding apparatus of a web-fed rotary printing press comprises moving a severing element in a traveling direction of the web with a speed, which is substantially equal to the traveling speed of the web, and simultaneously severing the web in a transverse direction with the severing element, thereby forming signatures of a predetermined length.

According to another object of the present invention, an apparatus for severing a running material web in a folding apparatus of a web-fed rotary painting press comprises a severing element, a first transport system for advancing said severing element in the traveling direction of the running web with a speed, which is substantially equal to the speed of the running web. The apparatus further comprises a second transport system for simultaneously advancing said severing element in a direction substantially lateral to the traveling direction of the web, thereby severing the running web substantially transversally.

Pursuant to another embodiment of the invention, the first transport system includes a first endless carrier system located at a first side of the web, and the second transport system includes a sled and a guiding element, such as a rail, for guiding the sled in the lateral direction. The guiding element is coupled to the first endless carrier system and the severing element is coupled to the sled such that the web is severed by the severing element, when the sled is moved along the guiding element.

According to another exemplary embodiment of the invention, a cam follower is formed at the sled, and an associated endless cam for guiding the cam follower is provided within the first endless carrier system. The cam comprises a portion running diagonally across the width of the web so that the sled can be moved from a first lateral edge of the web to a second lateral edge of the web, when the sled is moved in the traveling direction of the web. The cam follower tracks along the endless cam when the sled and the guiding element are moved in the traveling direction of the web.

Furthermore, the first endless carrier system includes a pair of parallel endless transport chains, which are located on either side of the running paper web and which are driven with substantially the speed of the web. In this exemplary embodiment of the invention, the guiding element is coupled to the transport chains and extends substantially transversally across the width of the web.

In another exemplary embodiment of the invention, a second endless carrier system is associated with the first endless carrier system. The second endless carrier system can be arranged below the first endless carrier system. The first and the second carrier systems can further comprise contacting portions formed by notched elements in which contacting portions are arranged such that the web is constrained between the contacting portions when said severing element is severing the web transversally.

According to another exemplary embodiment of the invention, the movement of the sled along the guide element is achieved by an electric drive and a belt system mounted to the guiding element or the transport chain of the first transport system. The severing element can either be a conventional blade or a rotary blade, which can be contacting an anvil element located on the other side of the web. Alternately, the severing element can be a laser beam from a laser source, a high-pressure fluid jet or an electrically heated element like a wire, which is fixedly mounted to the sled, or any other known severing device.

Another advantage of exemplary embodiments of the present invention is that continuous signature production can be achieved without interrupting the printing process for replacing or resharpening worn and dull blades.

BRIEF DESCRIPTION OF THE DRAWINGS

The foregoing and other objects and features of the present invention will become more apparent from the following detailed description of preferred embodiments when read in connection with the accompanying drawings, wherein.

DETAILED DESCRIPTION OF THE PREFERRED EMBODIMENTS

Figure 1:
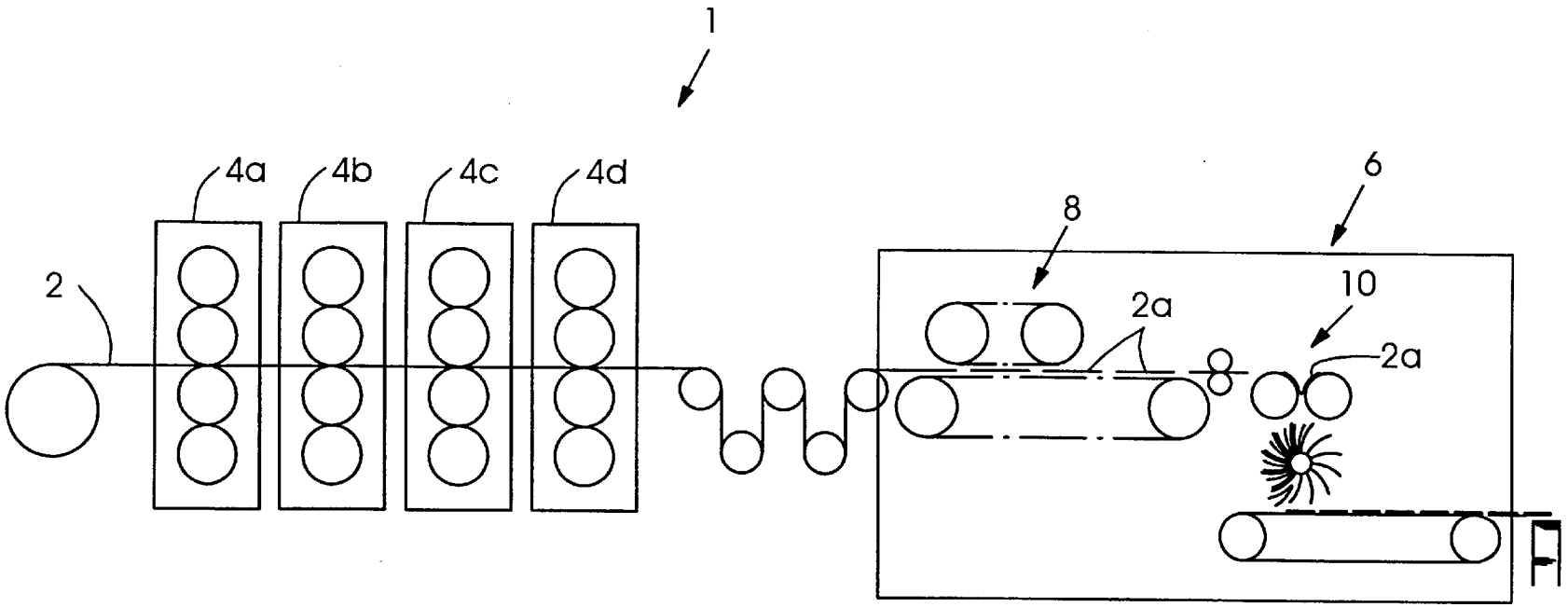
FIG. 1 is a schematic view of a web-fed rotary printing press with a severing apparatus according to an exemplary embodiment of the present invention.

As shown in FIG. 1, a web-fed rotary printing press 1 for printing a multi-colored image to a running material web 2 in one or more printing units 4*a* to 4*d* comprises a folding section 6 for cutting, folding and further processing the printed web 2. The folding section 6 includes a severing apparatus 8 for severing the printed web 2 into single signatures 2*a*. The single signatures 2*a* are then fed to a cross folding unit 10, which applies a cross-fold to the signatures 2*a*.

A basic operating principle of the severing apparatus 8, according to exemplary embodiments of the present invention, and the method for severing a web 2 into single signatures 2*a*, will now be explained with reference to FIG. 2. Severing of the material web 2, which is traveling in a direction indicated by arrow 10, with a speed $V_W$, is performed by a severing element 12, such as a blade, a laser beam, a high-pressure fluid jet, or a heated wire element or any other known severing device which is advanced along a path 14, as indicated by dashed lines in FIG. 2.

The path 14 of the cutting element 12 comprises multiple sections. In the path's first section 14*a*, the severing element 12 is advanced at a speed $V_1$, substantially parallel to the running web 2, a distance from a first side edge 16*a* of the web such that the severing element 12 is not in contact with the web 2. The direction and the speed $V_1$ of the severing element 12 in the first section 14*a* of the path 14 are indicated by arrow 11. The speed $V_1$ of the severing element 12 in the first section 14*a* is preferably larger than or equal to the web speed, $V_W$.

Figure 2:
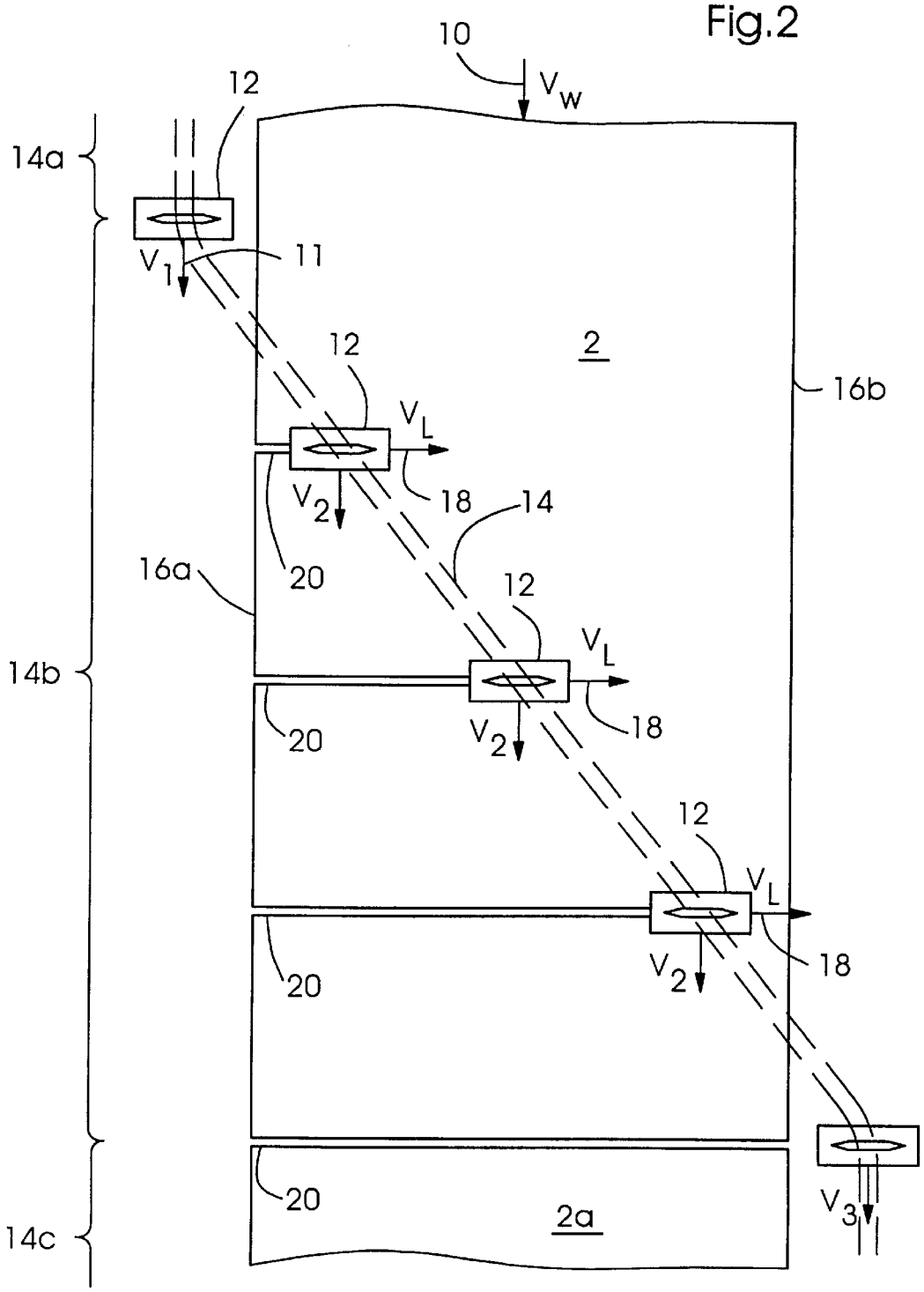
FIG. 2 is a schematic illustration of a basic principle of an exemplary method for severing a running web according to the present invention.

The path 14 of the severing element 12 further comprises a second section 14*b*, in which the severing element 12 is advanced from the first side edge 16*a* to the second side edge 16*b* of the web 2 with a lateral speed, $V_L$, which is indicated by arrows 18 in FIG. 2. During this lateral motion of the severing element 12, the severing element 12 is in contact with the web 2 and severs the web 2 transversally, with respect to the traveling direction 10 of the web 2, as it is indicated by the increasing length of the cross cut 20 associated with the different stages of the severing process shown in FIG. 2. In section 14*b* of the path 14, the speed $V_2$ of the severing element 12 in the traveling direction 10 of the web 12 is substantially equal to the traveling speed $V_W$ of the web 2. Thus, the cross cut 20 is substantially perpendicular to the traveling direction 10 of the web 2, regardless of the lateral speed $V_L$ of the severing element 12.

After the severing element 12 has reached the second side edge 16*b* of the web 2 and a signature 2*a* has been completely separated from the web 2, the severing element 12 is moved along a third section 14*c* of the path 14, in which it is not in contact with the web 2 or the signature 2*a*. The severing element can then be reversed, and move back toward the first section 14*a* of the path 14, as well as continue along path 14 in a forward direction. The speed $V_3$ in the third section 14 can be equal or larger than the speed $V_W$ of the running web 2.

The severing apparatus 8, which can used for severing a running material web, such as a paper web 2 into single signatures 2*a* will now be described in detail with reference to FIGS. 3 to 9. As shown in the exemplary FIG. 3 embodiment, the severing apparatus 8 comprises a first transport system 22 that includes a first endless carrier system 24 which is arranged on a first side 26*a* of the web 2. The severing apparatus 8 further includes a second endless carrier system 28, which is associated with the first endless carrier system 24 and located on the second side 25*b* of the web 2. The first side 26*a* and second side 26*b* can be the top and bottom, respectively of the horizontally ruing web 2 shown in FIG. 3. The first and/or second endless carrier systems 24, 28 can be independently driven by respective first and second drive systems 34, 36.

In an exemplary embodiment of the invention, each of the first and/or second endless carrier systems 24, 28 comprises a pair of parallel endless transport chains or belts 30 and 32 which are located near the first and the second side edges 16*a* and 16*b* of the web 2, respectively. As indicated in FIGS. 1–3, the length of the second endless carrier system 28 can be made longer than the length of the first endless carrier system 24, so that after the severing operation the single signatures 2*a* are arranged on top of the second endless carrier system 28 and can be transported to a subsequent section of the printing press, such as a cross-folding section 10 of the folding apparatus 6, for further processing.

Figure 3:
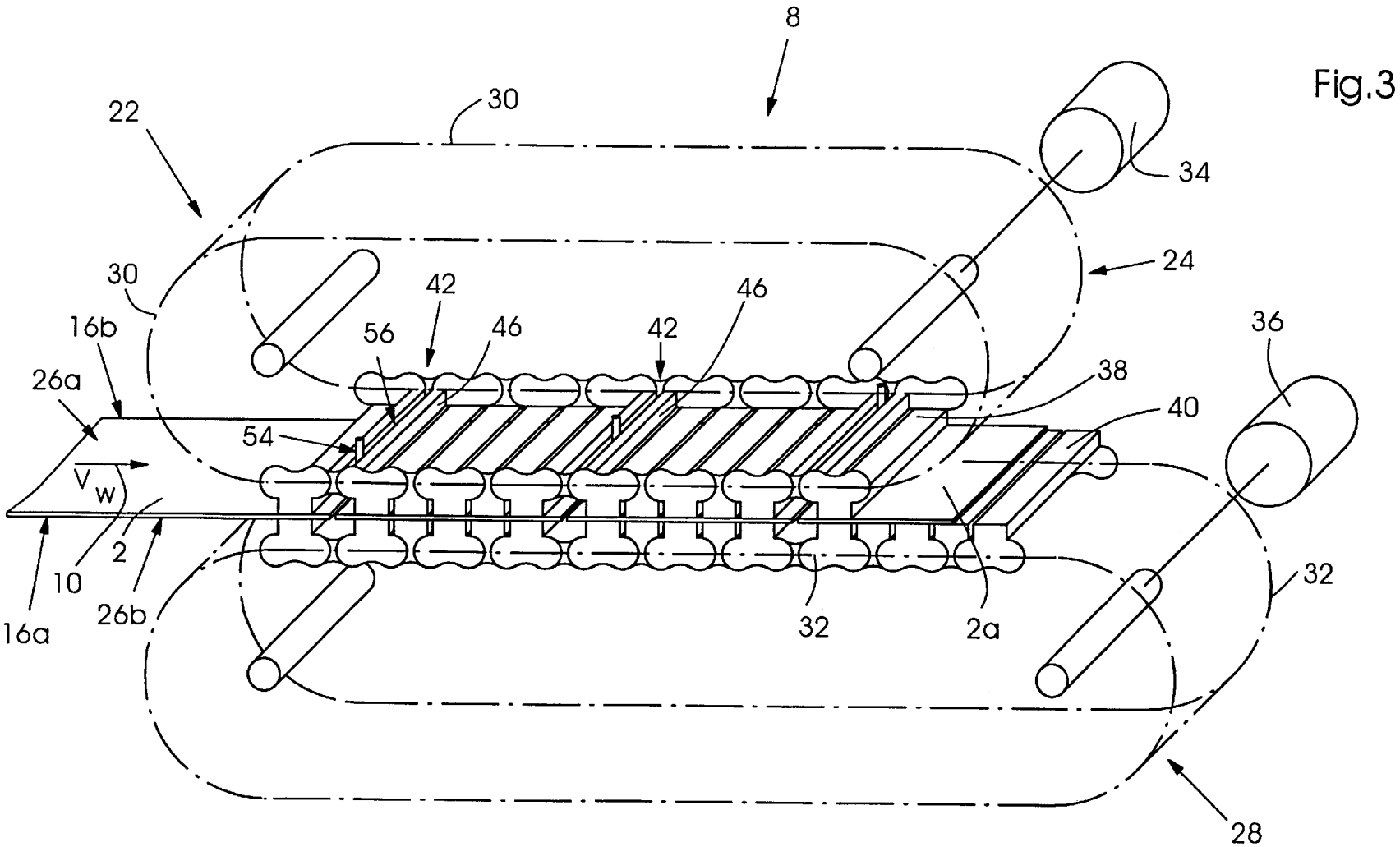
FIG. 3 is a schematic view of first and second endless carrier systems used in an exemplary severing apparatus according to the present invention.

Also shown in FIG. 3, a first plurality of cross members 38 is mounted to the chains or belts 30 of the first endless carrier system 24 and a second plurality of cross members 40 is mounted to the chains or belts 32 of the second endless carrier system 28. The first and/or second cross members 38, 40 can be formed of a notched rubber-type material and extend across the entire width of the web 2, thereby forming contacting portions 41, shown in FIG. 5, for constraining the running web 2 before, during and after the severing operation. Of course, any material can be used for cross members 38,40 which is able to create frictional contact sufficient to constrain the running web before, during and/or after the severing operation.

Figure 4:
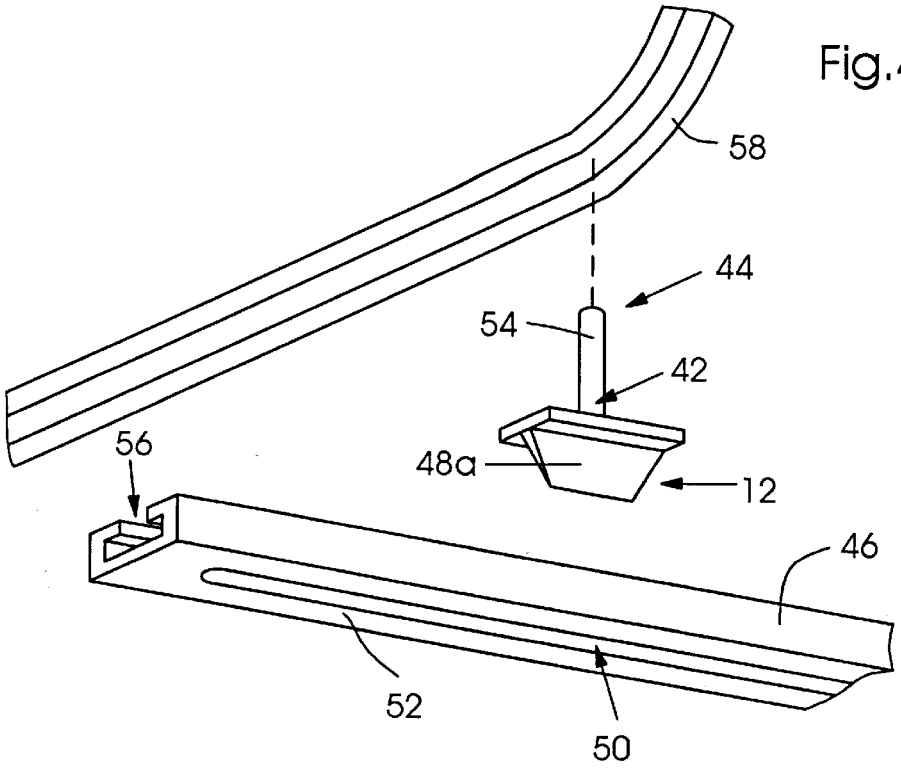
FIG. 4 is a perspective illustration of a sled and associated guiding element which can be used in an exemplary embodiment of the present invention.

A second transport system 42, shown in FIGS. 3 and 4, for advancing the severing elements 12 across the width of the web 2 in the lateral direction is provided on the first side 26*a*, such as the upper side, of the web 2. According to an exemplary embodiment of the invention, the second transport system 42 comprises a sled 44, on which the cutting element 12 is fixedly mounted. The sled 44 is received and guided in a guiding element,such as a hollow guiding rail 46, which is mounted to the chains or belts 30 of the first endless carrier system 24, whereby the orientation of the guiding rail 46 can be perpendicular to the traveling direction 10 of the web 2.

The severing element 12 is formed by a blade 48*a*, which is fixedly coupled to the sled 44 and which protrudes through a first longitudinal opening 50 formed in a first surface 52 of the guiding rail 46, shown in FIG. 4. The opening 50 extends substantially across the entire width of the web 2. A cam follower 54 is formed at the sled 44. The cam follower 54 protrudes through a second longitudinal slot 56, which is formed in a second surface 57 of the guiding rail 46. The first and second surfaces 52 and 67 can be arranged on opposite sides of the guiding rail 46, with the first surface 52 located adjacent to the web 2, as it is indicated in FIG. 5.

A cam 58 for receiving and guiding the cam follower 54 is associated with the cam follower 54. The cam 58 can be an endless cam, which is located at the inner side of the first endless carrier system 24 in the way shown in FIG. 6. The cam 58 comprises a cam portion 60 running diagonally across the width of the web 2, such as from the first side edge 16*a* to the second side edge 16*b*, so that the sled 44 is advanced laterally to the traveling direction 10 of the web 2 as the guiding element 46 and the sled 44 are advanced in the traveling direction 10 of the web 2. In other words, the sled 44 with the severing element 12 is automatically moved from one side edge of the web 2 to the second side edge of the web 2 as the guiding rail 46 with the sled 44 is moved in the traveling direction 10 of the web 2 by the transport chains or belts 30. As it can further be seen from FIG. 6, the endless cam 58 can comprise a reversing portion 61 in which the sled 44 is reversed from the second side edge 16*b* to the first side edge 16*a* of the web 2 in a lateral direction. The reversing portion 61 of the endless cam 58 can be located opposite to the portion 60, as it is indicated by dashed lines in FIG. 6. Therefore, the sled 44 with the severing element 12 is moved back and forth in the lateral direction, as the guiding rail 46 is advanced by the endless transport belts or chains 30 of the first endless carrier system 24.

Figure 5:
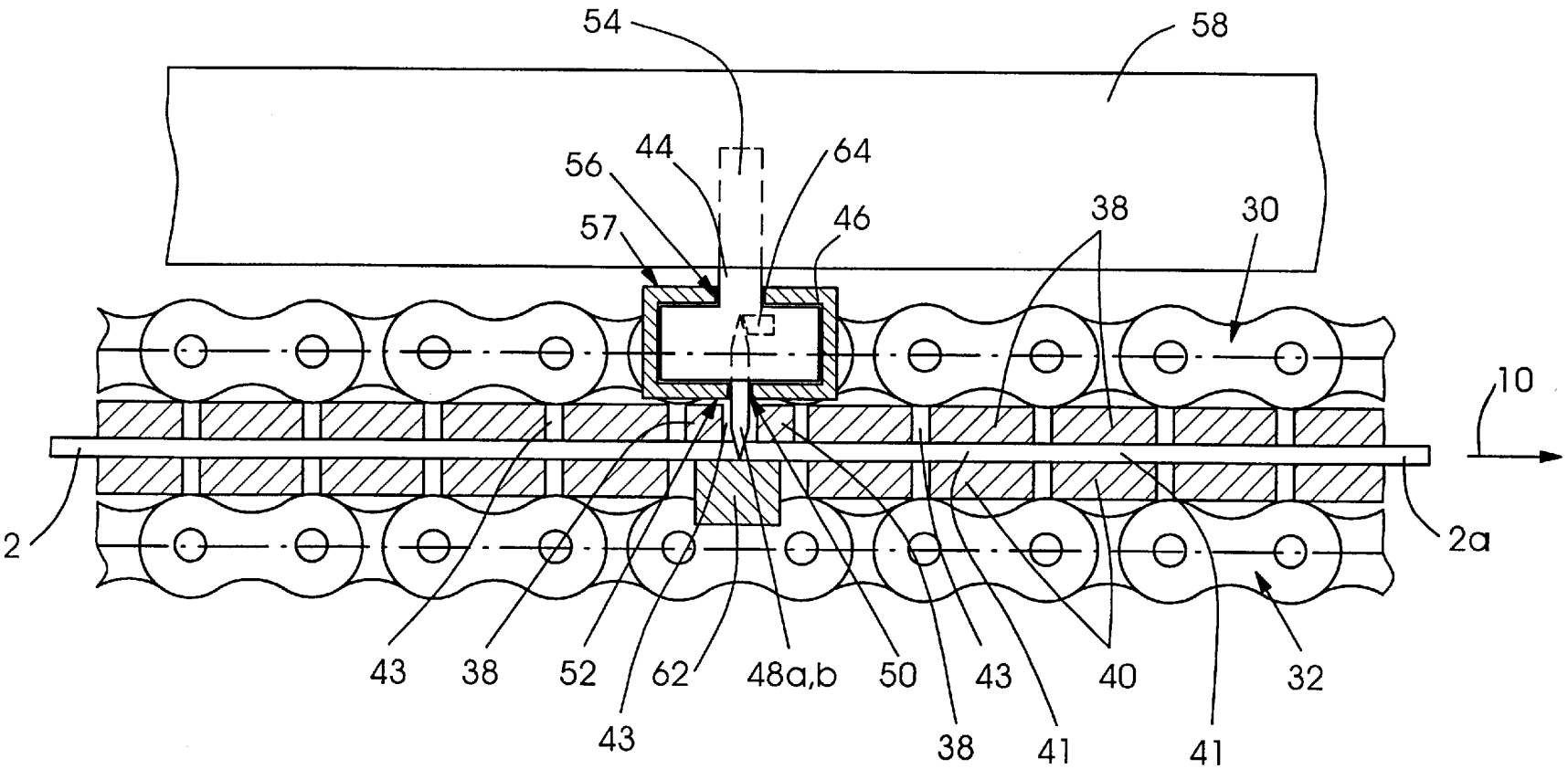
FIG. 5 is a more detailed cross-sectional view of the sled, the guiding element, the transporting chains and the respective contacting portions for constraining the web during the severing operation with an exemplary embodiment of the present invention.
Figure 6:
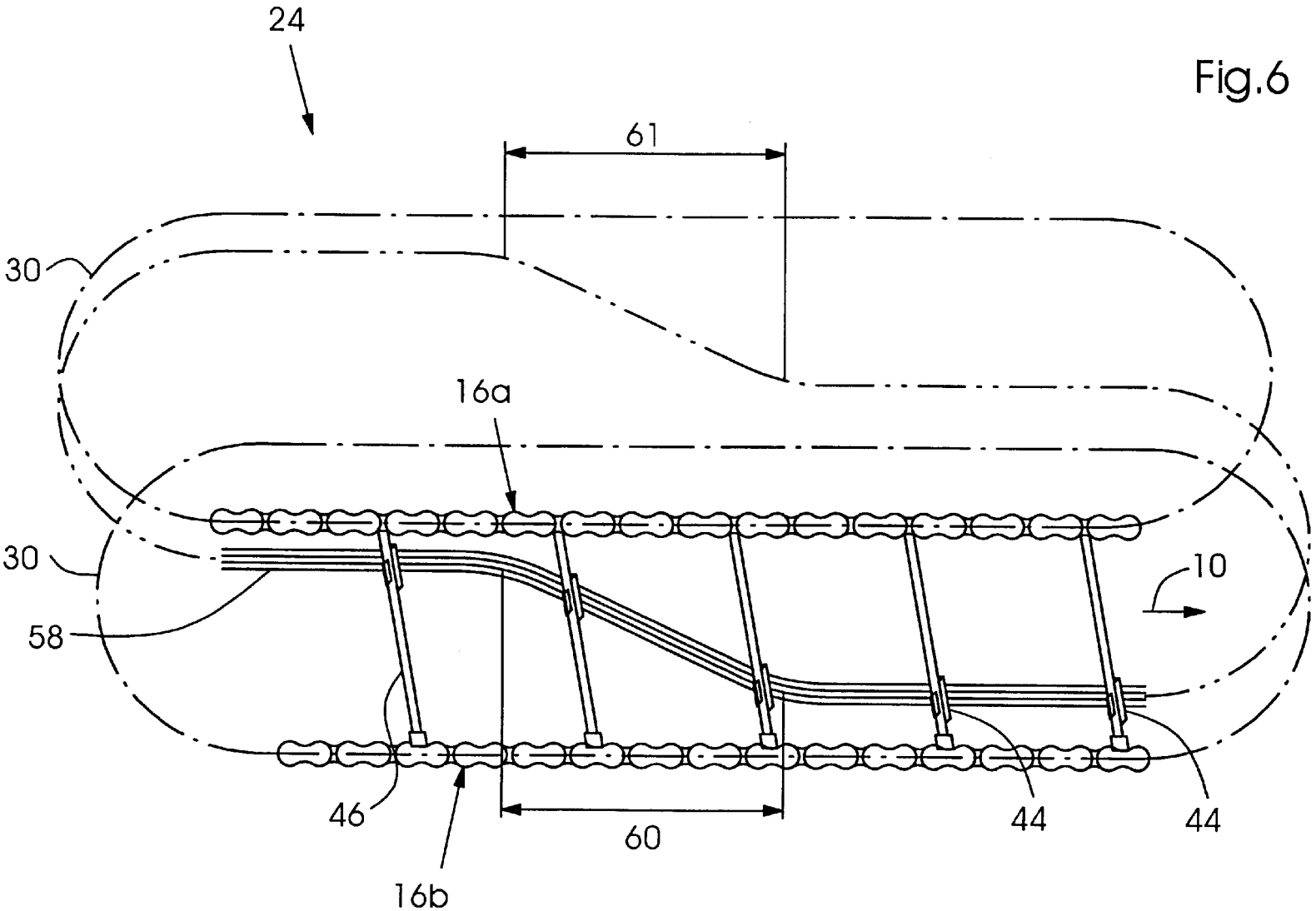
FIG. 6 is a perspective illustration of a first endless carrier system with an endless cam located within the first endless carrier system for receiving a cam follower coupled to the sled for automatically moving the sled in the lateral direction when the sled is advanced in the traveling direction of the web.
Figure 9:
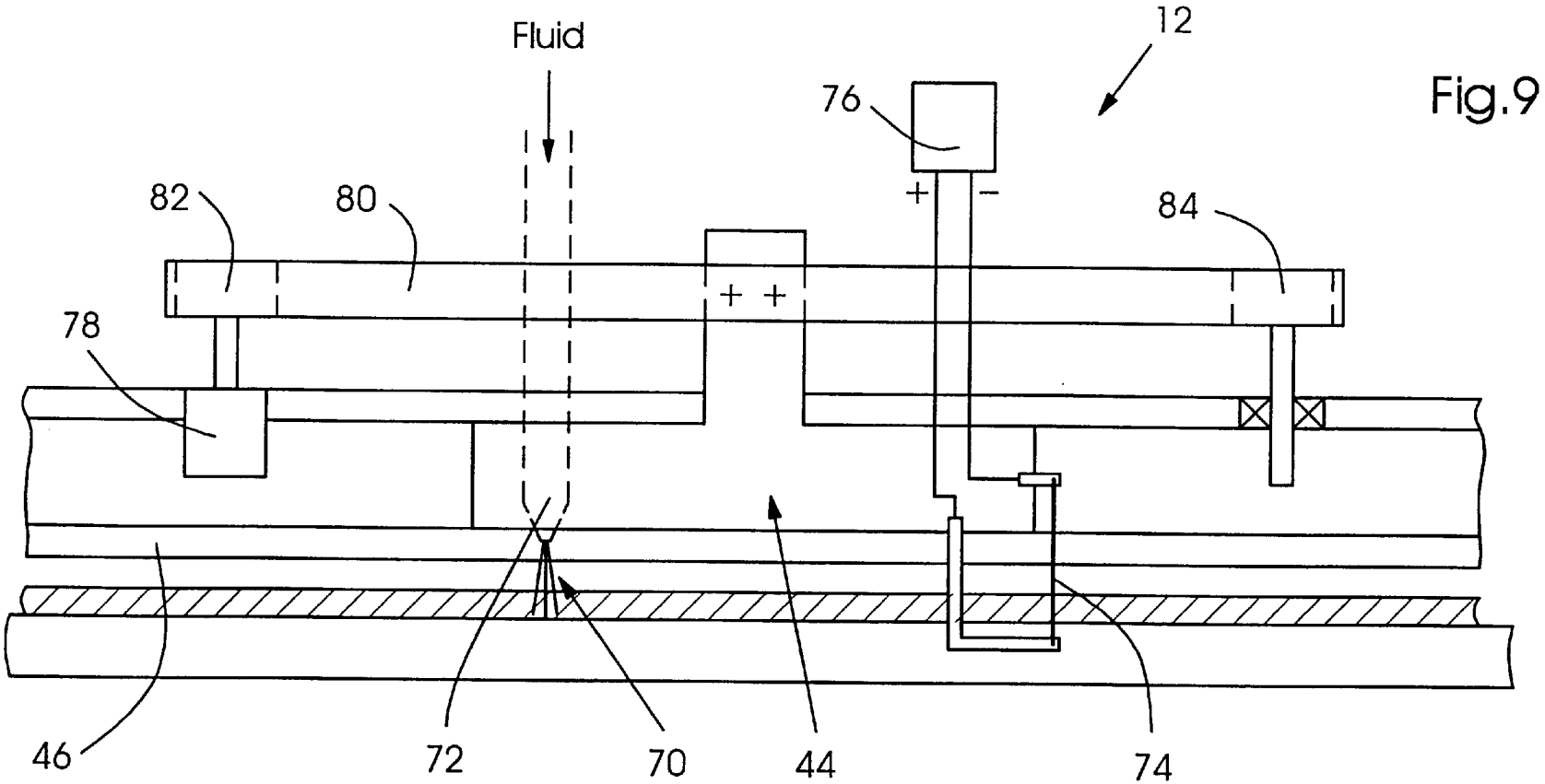
FIG. 9 shows a schematic view of another exemplary embodiment of the invention, in which the sled is carrying a high-pressure fluid jet or alternatively an electrically heated wire element for severing the paper web.

The guiding rail 46 can be mounted to the endless chains or belts 30 of the first carrier system 24 in such a way that the first opening 50 corresponds with a gap 43 formed between two neighboring cross members 38, shown in FIG. 5. This is done so that during the severing process the paper web 2 is securely constrained by respective contacting portions 41 formed between associated cross members 38 and 40 of the first and second endless carrier systems 24 and 28. The cutting blade 43 can be a conventional cutting blade 48*a* fixedly mounted at the sled 44, as it is shown in FIG. 4, or can be a rotary cutting blade 48*b*, which is rotatably supported at the sled 44, shown in FIG. 7, or can be any other suitably mounted cutting device.

As also shown in FIG. 5, an anvil element 62 can be provided with the cutting blades 48*a*, 48*b* respectively. The anvil element 62 can be a metal or a rubber bar or any other suitable material, which is in contact with the blades 48*a*, 48*b* when the respective blade is moved in the lateral direction, for severing the web 2 into signatures.

Figure 7:
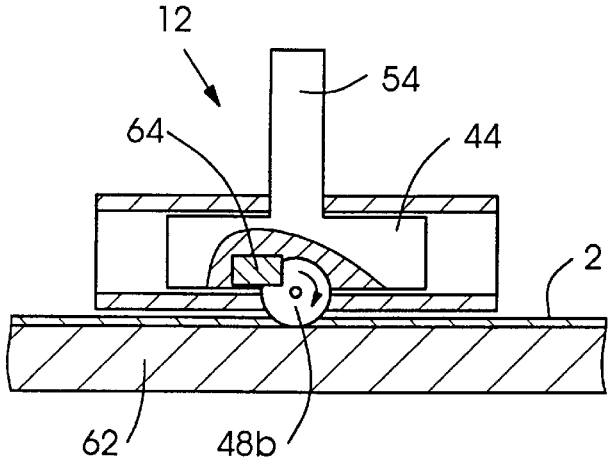
FIG. 7 is a schematic cross-sectional view of the sled with a rotary cutting blade and an associated anvil element according to another exemplary embodiment of the invention.

According to another exemplary embodiment of the invention, there can also be provided an automatic blade sharpener 64 for sharpening the respective blade 48*a*, 48*b* during or after the severing operation. In the case of a rotary cutting blade 48*b*, the automatic blade sharpener 64 may be a piece of grinding material, such as that used for grinding knives, which is in contact with the cutting portion of the rotary blade 48*b*. Of course, any material which provides the desired result of sharpening the blade can be used. An exemplary embodiment of a blade sharpener 64 is schematically shown in FIGS. 5 and 7.

Figure 8:
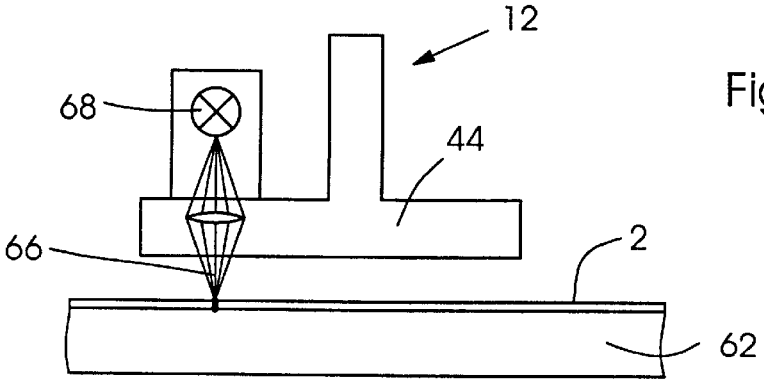
FIG. 8 is a schematic side view of the sled carrying a laser source for severing the web according to an exemplary embodiment of the present invention.

According to another exemplary embodiment of the invention, the severing element 12 can be a laser beam 66, which is emitted by a laser source 68 mounted to the sled 44, as 1n is schematically shown in the exemplary FIG. 8 embodiment. Alternately, the web 2 can also be severed by means of a known high-pressure fluid jet 70, which is emitted from a nozzle 72 towards the surface of the paper web 2, or by a heated metal wire 74 connected to an electric power supply 76 as it is schematically shown in the exemplary FIG. 9 embodiment.

Furthermore, instead of using a cam 58 and an associated cam follower 54, there can be used a known electric or pneumatic drive 78, such as a stepper motor, for advancing the sled 44 in the lateral direction or any known drive device. In this exemplary embodiment of the invention shown in FIG. 9, an electric drive 78 with a first pulley 82 is mounted at a first end of the guiding rail 46 and a second pulley 84 is rotatably coupled to the second end of the guiding rail 46. A belt 80, such as a toothed belt, extending from the first pulley 82 to the second pulley 84 can be fixedly coupled to the sled 44, so that when the first pulley 82 is rotated by the electric drive 78, the sled 44 with the severing element 12 is advanced along the guiding rail 46.

It will be appreciated by those skilled in the art that the present invention can be embodied in other specific forms without departing from the spirit or the essential character thereof. The presently disclosed embodiments are therefore considered in all respects to be illustrative and not restrictive. The scope of the invention is indicated by the appended claims rather than the foregoing description and all changes which come within the meaning and range of equivelants thereof are intended to be embraced therein.

What is claimed is:

1. Method for severing a running material web in a folding apparatus of a web-fed rotary printing press comprising the steps of:

moving a severing element located in said folding apparatus of said printing press along a substantially flat plane in a traveling direction of the web with a speed which is substantially equal to a traveling speed of the web; and simultaneously severing the web in a transverse direction by moving said severing element in a direction transverse to the travelling direction of the web; thereby forming signatures of a predetermined length, werein said web is traveling along a substantially flat plane when being severed.

2. Method of claim 1, wherein the web is constrained when severing the web in said transverse direction.

3. Method of claim 1, wherein said severing element includes a blade for severing the web.

4. Method of claim 1, wherein said severing element includes a laser beam for severing the web.

5. Method of claim 1, wherein said severing element includes a high-pressure fluid jet for severing the web.

6. Method of claim 1, wherein said severing element includes a heated element for severing the web.

7. The method of claim 1, further comprising the step of:

moving the severing element in a direction transverse to the traveling direction of the web during said severing.

8. Apparatus for severing a running material web in a folding apparatus of a web-fed rotary printing press comprising:

a severing element located in said folding apparatus of said printing press;

a first transport system for advancing said severing element along a substantially flat plane in a traveling direction of the running web with a speed which is substantially equal to the speed of the running web, wherein said running web is traveling along a substantially flat plane when being severed; and a second transport system for simultaneously advancing said severing element in a direction substantially lateral to said traveling direction of the web.

9. Apparatus of claim 8, further including: said first transport system further includes a first endless carrier system located on a first side of the web and said second transport system includes a sled and a guiding element for guiding said sled in said lateral direction;

said guiding element being coupled to said first endless carrier system and said severing element being coupled to said sled such that the web is severed by said severing element when advancing said sled along said guiding element.

10. Apparatus of claim 9, further including: a cam follower formed at said sled and an associated endless cam for guiding said cam follower within said first endless carrier system;

said cam having a portion running diagonally across the width of the web such that said sled is advanced from a first lateral edge to a second lateral edge of the web when said sled is advanced in the traveling direction of the web.

11. Apparatus of claim 9, wherein said first endless carrier system further includes a pair of parallel endless transport chains located on either side of the material web and being driven with substantially web speed, said guiding element extending transversally across the material web and being coupled to said transport chains.

12. Apparatus of claim 9, wherein a second endless carrier system associated with said first endless carrier system is located on a second side of the web;

said first and second carrier systems defining contacting portions and being arranged such that the material web is constrained by said contacting portions when said severing element is advanced in said lateral direction for severing the web.

13. Apparatus according to claim 9, further comprising an electric drive for moving said sled along said guiding element.

14. Apparatus according to claim 9, wherein said severing element includes a blade for severing the material web.

15. Apparatus of claim 14, wherein an anvil element is associated with said blade; said blade being in contact with said anvil element when severing the web.

16. Apparatus of claim 15, wherein said blade is a rotary blade rotatably supported on said sled.

17. Apparatus of claim 16, wherein a blade sharpener is provided for sharpening said blade when said blade is rotated.

18. Apparatus of claim 8, wherein said severing element includes a laser source emitting a laser beam that is directed towards the material web for severing the material web.

19. Apparatus of claim 8, wherein said severing element includes a high-pressure fluid jet for severing the material web.

20. Apparatus of claim 8, wherein said severing element includes a heated element for severing the material web.

* * * * *